United States Patent [19]

Renken

[11] Patent Number: 4,912,933

[45] Date of Patent: Apr. 3, 1990

[54] TRANSPORT REFRIGERATION SYSTEM HAVING MEANS FOR ENHANCING THE CAPACITY OF A HEATING CYCLE

[75] Inventor: David J. Renken, Minneapolis, Minn.

[73] Assignee: Thermo King Corporation, Minneapolis, Minn.

[21] Appl. No.: 338,919

[22] Filed: Apr. 14, 1989

[51] Int. Cl.[4] ..... F25B 13/00

[52] U.S. Cl. ..... 62/81; 62/158; 62/160; 62/197; 62/278; 62/174

[58] Field of Search ..... 62/197, 278, 81, 160, 62/158, 157, 231, 234, 503, 509, 196.4, 159, 174, 324.1, 324.4, 324.5, 324.6

[56] References Cited

U.S. PATENT DOCUMENTS

| | | | |
|---|---|---|---|
| 2,693,683 | 11/1954 | Toothman | 62/509 X |
| 2,878,654 | 3/1959 | Kramer | 62/278 |
| 3,219,102 | 11/1965 | Taylor | 62/81 X |
| 4,122,686 | 10/1978 | Lindahl et al. | 62/278 X |
| 4,122,688 | 10/1978 | Mochizuki et al. | 62/278 X |
| 4,437,317 | 3/1984 | Ibrahim | 62/278 X |
| 4,602,485 | 7/1986 | Fujimoto et al. | 62/174 |
| 4,748,818 | 6/1988 | Satterness et al. | 62/160 |

*Primary Examiner*—Harry B. Tanner
*Attorney, Agent, or Firm*—D. R. Lackey

[57] ABSTRACT

A transport refrigeration system which includes a compressor, a condenser, a receiver, an evaporator, an accumulator, and a control valve which selectively initiates heating and cooling cycles. The heating capacity of a heating cycle is enhanced by connecting the outlet of the receiver to the inlet of the accumulator just prior to each heating cycle, while maintaining the control valve in a cooling position for a predetermined time delay. This forces any liquid refrigerant trapped in the condenser to flow into the receiver, while lower pressure in the accumulator causes liquid refrigerant in the receiver to flow into the accumulator, to provide additional liquid refrigerant in the accumulator at the start of the heating cycle, which is initiated at the end of the predetermined time delay.

8 Claims, 4 Drawing Sheets

TRANSPORT REFRIGERATION SYSTEM HAVING MEANS FOR ENHANCING THE CAPACITY OF A HEATING CYCLE

BACKGROUND OF THE INVENTION

1. Field of the Invention

The invention relates in general to transport refrigeration systems, and more specifically to such systems having heating and cooling cycles which utilize hot compressor discharge gas.

2. Description of the Prior Art

Transport refrigeration systems for conditioning the loads of trucks and trailers have cooling, null and heating modes. The heating mode includes a heating cycle for controlling load temperature to a set point, as well as a heating cycle for defrosting the evaporator coil. When the system switches from a cooling or null mode into a heating cycle, hot compressor discharge gas is diverted by suitable valve means from the normal refrigerant circuit which includes a condenser, receiver, expansion valve, evaporator, and accumulator, to a circuit which includes the compressor, evaporator and accumulator.

To make more liquid refrigerant available during a heating cycle, a normal prior art procedure pressurizes the receiver with the hot compressor discharge gas to force liquid refrigerant out of the receiver and into the refrigerant cooling circuit. A bleed port in the expansion valve allows this liquid to flow into the evaporator during the heating cycle, to improve heating or defrosting capacity.

U.S. Pat. No. 4,748,818, which is assigned to the same assignee as the present application, improved upon the normal prior art procedure by eliminating the pressure line to the receiver, and by connecting the output of the receiver to the accumulator during a heating cycle. While this allowed some refrigerant to flow from the condenser to the receiver, I found that a substantial amount of refrigerant was still being trapped in the condenser, especially at low ambients, e.g., below about +15° F. (−9.44° C.).

SUMMARY OF THE INVENTION

Briefly, the present invention is a new and improved transport refrigeration system, and method of operating same, which improves upon the arrangement of the aforesaid U.S. Pat. No. 4,748,818. Similar to the '818 patent, the present invention connects the receiver and accumulator in direct fluid flow communication via a solenoid valve, but the connection is initially made just prior to the initiation of a heating cycle instead of simultaneously therewith. After this flow path is established, the actual heating cycle is delayed for a predetermined period of time during which hot gas from the compressor continues to flow to the condenser. With the establishment of the direct fluid flow connection between the receiver and accumulator, and the low pressure at the accumulator compared with the pressure at the output of the receiver, the hot high pressure gas directed to the condenser during the delay period will flush out any liquid refrigerant trapped in the condenser, forcing it into the receiver and from the receiver to the accumulator.

After the delay period, the heating cycle commences, with a supply of liquid refrigerant in the accumulator sufficient to provide near maximum heating capability during heating and defrost cycles, even at very low ambients.

In a preferred embodiment of the invention, the normal condenser check valve is moved from the output of the condenser to the outlet of the receiver, before the tee which branches to the accumulator via the solenoid valve. It was found that during a heating cycle the expansion valve was opening and allowing hot refrigerant gas to flow into the liquid line where it condensed and flowed back into the receiver. The new location of the check valve, which will be called a receiver check valve, prevents liquid refrigerant from entering the receiver from the liquid line.

In the preferred embodiment, the direct fluid flow communication between the output of the receiver and the input of the accumulator is maintained after the flushing cycle, during the following heating cycle. By maintaining the flow path from the output of the receiver check valve to the accumulator, any condensed refrigerant in the liquid line simply returns to the accumulator, keeping it available for enhancement of the heating cycle.

BRIEF DESCRIPTION OF THE DRAWING

The invention will become more apparent by reading the following detailed description in conjunction with the accompanying drawings, which are shown by way of example only, wherein.

DESCRIPTION OF PREFERRED EMBODIMENTS

The hereinbefore mentioned U.S. Pat. No. 4,748,818, as well as U.S. Pat. Nos. 3,219,102; 4,325,224; and 4,419,866, which are assigned to the same assignee as the present application, describe transport refrigeration systems in detail, and they are hereby incorporated into the present application by reference so the following description may concentrate on the inventive aspects of a transport refrigeration system.

Figure 1:
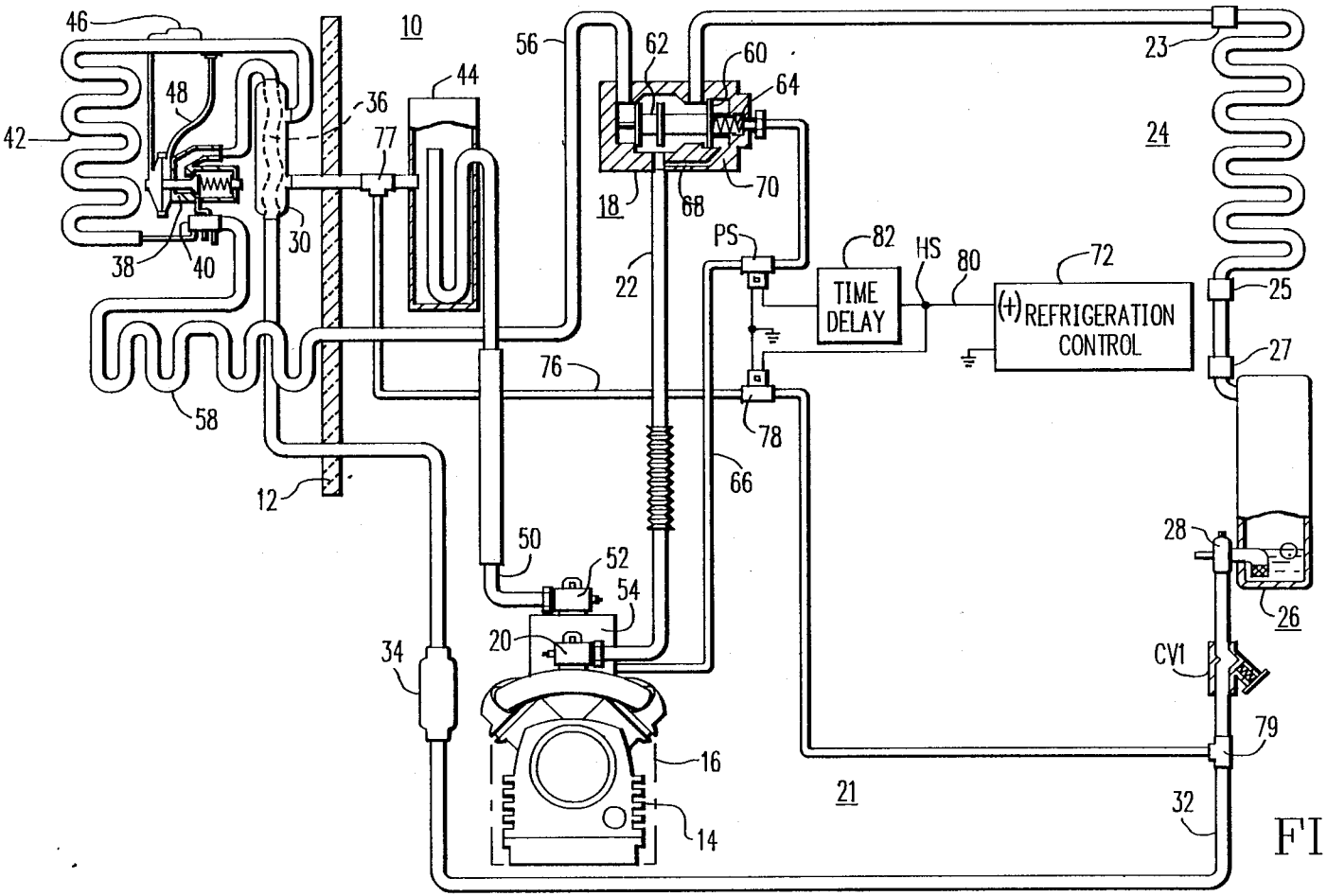
FIG. 1 illustrates a transport refrigeration system constructed according to the teachings of the invention.

Referring now to FIG. 1, there is shown a transport refrigeration system 10 constructed according to the teachings of the invention. Refrigeration system 10 is mounted on the front wall 12 of a truck or trailer. Refrigeration system 10 includes a closed fluid refrigerant circuit 21 which includes a refrigerant compressor 14 driven by a prime mover, such as an internal combustion engine indicated generally by broken outline 16. Discharge ports of compressor 14 are connected to an inlet port of a three-way valve 18 via a discharge service valve 20 and a hot gas conduit or line 22. The functions of the three-way valve 18, which has heating and cooling positions, may be provided by separate valves, if desired.

One of the output ports of three-way valve 18 is connected to an inlet side 23 of a condenser coil 24. This output port is used in the cooling position of threeway valve 18, and it connects compressor 14 in a first refrigerant circuit. This output port of three-way valve 18 is also used in a flushing cycle or mode, which will be hereinafter explained. An outlet side 25 of condenser coil 24 is connected to an inlet side 27 of a receiver tank 26, which includes an outlet side 28 which may include a service valve. A one-way condenser check valve CV1 which is located at the outlet side 25 of condenser 24 in the '818 patent, is moved to the outlet side 28 of receiver 26 in the present invention. Thus, check valve CV1 enables fluid flow only from the outlet side 28 of receiver 26 to a liquid line 32, while preventing flow of liquid refrigerant flow back into receiver 26 via outlet 28. The output side of check valve CV1 is connected to a heat exchanger 30 via the liquid line 32 which includes a dehydrator 34.

Liquid refrigerant from liquid line 32 continues through a coil 36 in heat exchanger 30 to an expansion valve 38. The outlet of expansion valve 38 is connected to a distributor 40 which distributes refrigerant to inlets on the inlet side of an evaporator coil 42. The outlet side of evaporator coil 42 is connected to the inlet side of a closed accumulator tank 44 by way of heat exchanger 30. Expansion valve 38 is controlled by an expansion valve thermal bulb 46 and an equalizer line 48. Gaseous refrigerant in accumulator tank 44 is directed from the outlet side thereof to the suction port of compressor 14 via a suction line 50, a suction line service valve 52, and a suction throttling valve 54.

In the heating position of three-way valve 18, a hot gas line 56 extends from a second outlet port of three-way valve 18 to the inlet side of evaporator coil 42 via a defrost pan heater 58 located below evaporator coil 42. A pressurizing tap, such as shown in FIG. 1 of the incorporated '866 patent, which commonly extends from hot gas line 56 to receiver tank 26 via by-pass and service check valves, is eliminated by the present invention, as is the need for a bleed port in expansion valve 38.

Three-way valve 18 includes a piston 60, a spool 62, and a spring 64. A conduit 66 connects the front or spring side of piston 60 to the intake side of compressor 14 via a normally closed pilot solenoid valve PS. When solenoid operated valve PS is closed, three-way valve 18 is spring biased to the cooling position, to direct hot, high pressure gas from compressor 14 to condenser coil 24. A bleed hole 68 in valve housing 70 allows pressure from compressor 14 to exert additional force against piston 60, to help maintain valve 18 in the cooling position. Condenser coil 24 removes heat from the gas and condenses the gas to a lower pressure liquid.

When evaporator 42 requires defrosting, and also when a heating mode is required to hold the thermostat set point of the load being conditioned, pilot solenoid valve PS is opened after a predetermined time delay, as will be hereinafter explained, via voltage provided by a refrigeration electrical control function 72. Pressure on piston 60 thus dissipates to the low side of the system. Pressure of the back side of piston 60 then overcomes the pressure exerted by spring 64, and the assembly which includes piston 60 and spool 62 moves, operating three-way valve 18 to its heating position, in which flow of refrigerant to condenser 24 is sealed and flow to evaporator 42 is enabled. Suitable control 72 for operating solenoid valve PS is shown in the incorporated patents, as well as in FIG. 2 of the present application, which will be hereinafter described.

The heating position of three-way valve 18 diverts the hot high pressure discharge gas from compressor 14 from the first or cooling mode refrigerant circuit into a second or heating mode refrigerant circuit which includes conduit 56, defrost pan heater 58, distributor 40, and the evaporator coil 42. Expansion valve 38 is bypassed during the heating mode. If the heating mode is initiated by a defrost cycle, an evaporator fan (not shown) is not operated, or if the fan remains operative, an air damper (not shown) is closed to prevent warm air from being delivered to the served space. During a heating cycle required to hold a thermostat set point temperature, the evaporator fan is operated and any air damper remains open.

In addition to eliminating the need for a pressurizing tap from line 56 to receiver tank 26, a line or conduit 76 is provided which extends from a tee 77 located at the inlet side of accumulator 44 to a tee 79 located at the outlet side of receiver 26, between check valve CV1 and liquid line 32. Line 76 includes a normally closed solenoid valve 78. The need for a check valve in line 76, to prevent flow of refrigerant from accumulator 44 to receiver 26 in cold ambients, while required in the '818 patent, is not required in the present invention due to the new location of check valve CV1.

When heat mode control 72 detects the need for a heating cycle, such as to hold set point, or to initiate a defrost operation, it provides a "heat signal" HS which energizes an output conductor 80.

When conductor 80 is energized by heat signal HS, solenoid valve 78 in line 76 is immediately energized and thus opened, to establish fluid flow communication from liquid line 32 to the input of accumulator 44. Pilot solenoid valve PS, however, is not immediately energized, as a normally open time delay switch 82 is located between heat mode control 72 and pilot solenoid valve PS. When heat mode control 72 energizes conductor 80, time delay switch 82 immediately starts timing a pre-selected timing period. After the delay provided by the selected timing period, time delay switch 82 closes to energize pilot solenoid PS and start the heating cycle.

Figure 2:
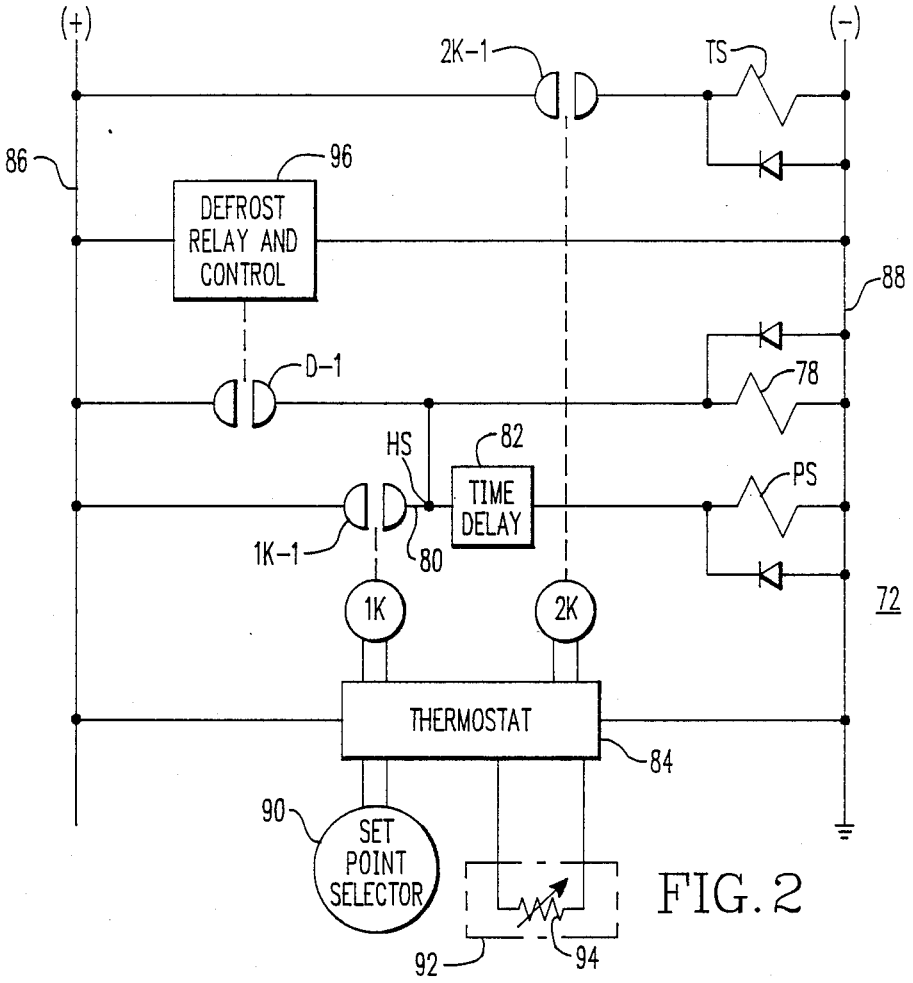
FIG. 2 is a schematic diagram of refrigeration control which may be used with the transport refrigeration system shown in FIG. 1.

FIG. 2 illustrates an exemplary schematic diagram which may be used for refrigeration control 72. A thermostat 84 is connected between conductors 86 and 88 of an electrical power supply, with thermostat 84 being responsive to the selection of a set point selector 90. Conductor 88 is grounded. Thermostat 84 senses the temperature of a controlled space 92 via a sensor 94 and in response thereto initiates high and low speed heating and cooling cycles via a heat relay 1K and a speed relay 2K.

Heat relay 1K, when de-energized, indicates the need for a cooling cycle or mode, and when energized it indicates the need for a heating cycle or mode. Heat relay 1K includes a normally open contact set AK-1 connected from the power supply conductor 86 to conductor 80 and a terminal HS. Terminal Hs provides the hereinbefore mentioned heat signal HS. Time delay function 82 and solenoid valve 78 are connected between terminal HS and ground conductor 88. In addition to heat relay 1K providing heat signal HS, a defrost relay and associated control, indicated generally at 96, controls a normally open contact set D-1 connected to parallel contact set 1K-1. Thus, when control 96 detects the need to defrost the evaporator 42, a defrost relay in defrost control 96 will close contact set D-1 and provide a true heat signal HS.

Speed relay 2K, when energized, selects a high speed mode of prime mover 16, such as 2200 RPM, and when de-energized it selects a low speed mode, such as 1400 RPM Speed relay 2K has a normally open contact set 2K-1 which energizes a throttle solenoid TS when closed, with throttle solenoid TS being associated with prime mover 16 shown in FIG. 1.

During the time delay period provided by time delay function 82, system 10 is in a flushing mode or cycle which transfers liquid refrigerant from condenser 24 and receiver 26 to accumulator 44. Since valve 18 is still in its cooling position during the flushing cycle, hot, high pressure gaseous refrigerant from compressor 14 is directed to condenser 24. With line 76 now open, and with the relatively low pressure which exists at the accumulator 44, substantially all of the liquid refrigerant in condenser 24, and substantially all of the liquid refrigerant in receiver 26, flow to the accumulator 44 due to the pressure differential. When liquid refrigerant leaving check valve CV1 encounters tee 79, it will take the path of least resistance, flowing to the low pressure side of the system, which exists at the accumulator 44, rather than to the restriction presented by the system between the tee 79 and evaporator coil 42. The pressure differential responsible for the condenser and receiver "flush" ranges from about 14 psi to about 75 psi, depending upon the ambient temperature and the type of refrigerant used.

Using a special sight gauge mounted on accumulator 44 during tests, it was found that the level of liquid refrigerant in accumulator 44 rose from near the bottom of the tank to ½ to ⅔ of the height of the accumulator tank 44 during the flushing mode.

System 10 operates the same as prior art transport refrigeration systems during a cooling cycle. When refrigeration control 72 senses that a heating cycle is required, a true heat signal HS is provided. The heat signal HS energizes conductor 80, picking up solenoid 78 to open line 76, and conductor 80 also energizes the time delay function 82. System 10 then operates in the flushing mode. When the time delay expires, pilot solenoid PS is energized, switching valve 18 to its heating position. Solenoid valve 78 remains energized during the heating cycle, to provide a path for any liquid refrigerant in liquid line 32 to return to accumulator 44.

Check valve CV1 prevents any liquid refrigerant from re-entering the receiver 26. It was found that expansion valve 38 opened during a heating cycle, allowing hot gaseous refrigerant to enter liquid line 32 and condense. Without check valve CV1, this liquid refrigerant was finding its way back into receiver 26, resulting in a reduction in heating capacity after each heating cycle. Thus, check valve CV1 prevents this from occurring.

Instead of allowing liquid line to fill with liquid, which would occur if valve 78 were to be closed during the heating cycle, valve 78 is allowed to remain energized and open during a heating cycle, providing a return path to the accumulator for any liquid refrigerant in liquid line 32.

The time delay period of time delay switch 82 is selected to provide the amount of time required to flush condenser 24 and receiver 26 of liquid refrigerant. This time depends upon the ambient temperature, the size of condenser 24, the diameter of line 76, and size of the orifice in solenoid valve 78. It has been found that about a 2 minute time delay is adequate for an ambient of −20° F. to about 0° F. (−28.89° C. to −17.8° C., using 9 pounds of refrigerant R12, a line 76 having a 0.25 inch (6.35 mm) diameter opening, and an orifice opening of 0.156 inch (3.96 mm) in solenoid valve 78.

Since the only variable is the ambient temperature, time delay switch could be programmed to have a time delay proportional to the ambient temperature, if desired, with no delay above about +15° F. (−9.44° C.), and the maximum delay at about −20° F. (−28.89° C.).

Figure 3:
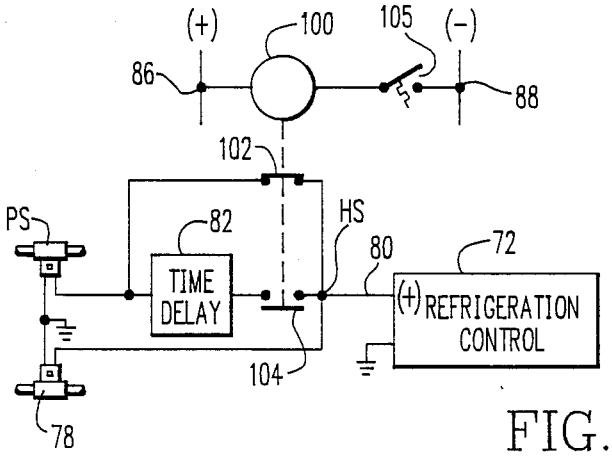
FIG. 3 illustrates a modification to the transport refrigeration system of FIG. 1 which may be used.

Instead of a variable time delay, it would also be practical to enable the time delay function 82 only when the ambient temperature falls below a predetermined value, such as below +15° F. (−9.44° C.), with the time delay period being pre-selected, such as about 2 minutes. FIG. 3 sets forth such an embodiment which uses a relay 100 having a normally closed contact set 102 and a normally open contact set 104, and a normally open thermal switch 105, which, for example, closes at ambients of +15° F. (−9.44° C.) and below, and is otherwise open. Above an ambient of +15° F. (−9.44° C.), contact set 102 is closed and when control 72 energizes conductor 80, both the pilot solenoid valve PS and solenoid valve 78 are energized simultaneously. Below +15° F. (−9.44° C.), thermal switch 105 closes to energize relay 100, opening contact set 102 and closing contact set 104, enabling the time delay function 82.

In comparison tests between the hereinbefore described prior art arrangements and a system constructed according to the teachings of the invention, both using refrigerant R12, it was found that the prior art systems had a capacity of about 2700 to 5400 BTU/HR at an ambient of 0° F. (−17.8° C.), and a capacity of 0 BTU/HR at an ambient of −20° F. (−28.89° C.), with the system thermostat set at 35° F. (1.67° C.). A system similar to the prior art systems, except constructed according to the teachings of the invention, i.e., which includes a flushing cycle following each cooling cycle and preceding each heating cycle, provided a heating capacity of 15,700 BTU/HR at an ambient temperature of 0° F. (−17.8° C.), and a capacity of 15,000 BTU/HR at an ambient temperature of −20° F. (−28.89° C.).

Figure 4:
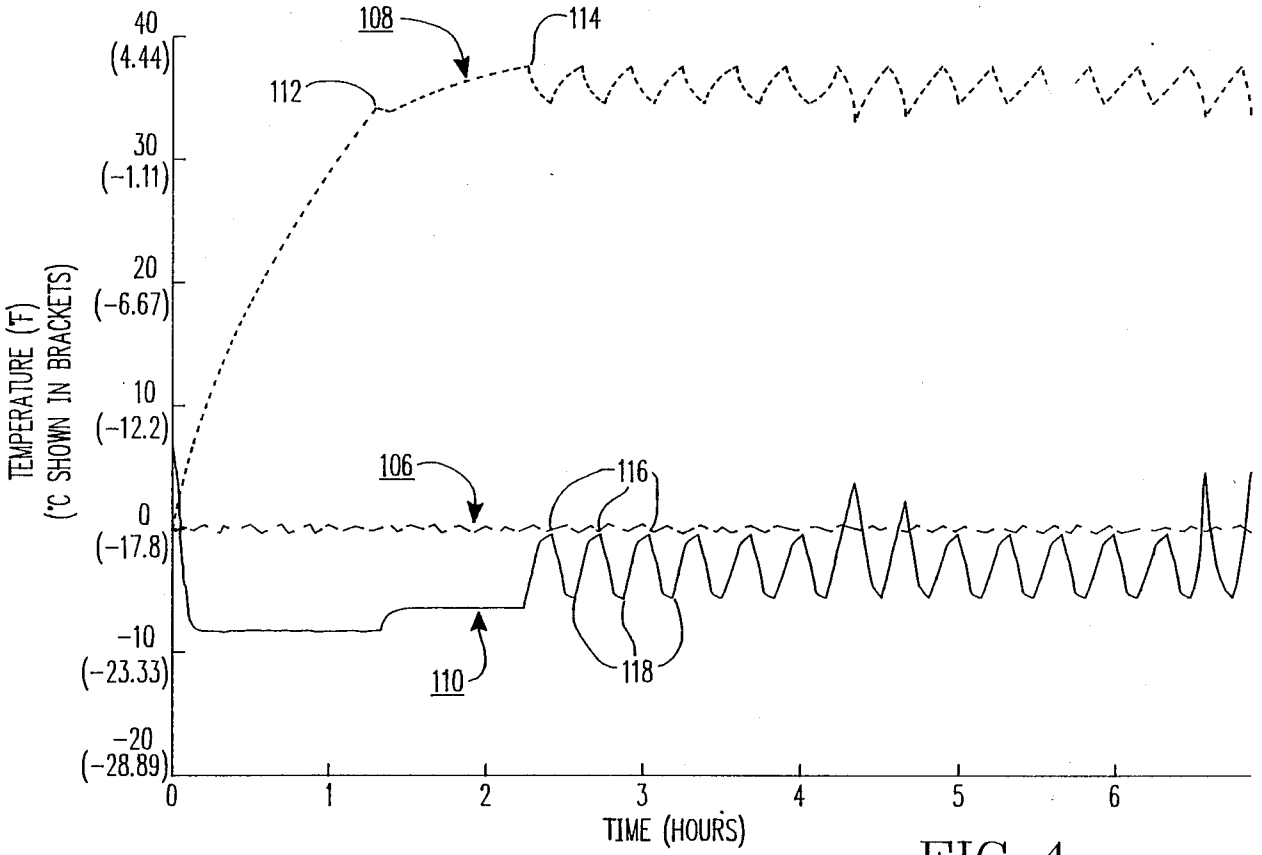
FIG. 4 is a graph which plots certain temperatures associated with a transport refrigeration system constructed according to the teachings of the invention versus time, when operated with an ambient of 0° F. (−17.8° C.)
Figure 5:
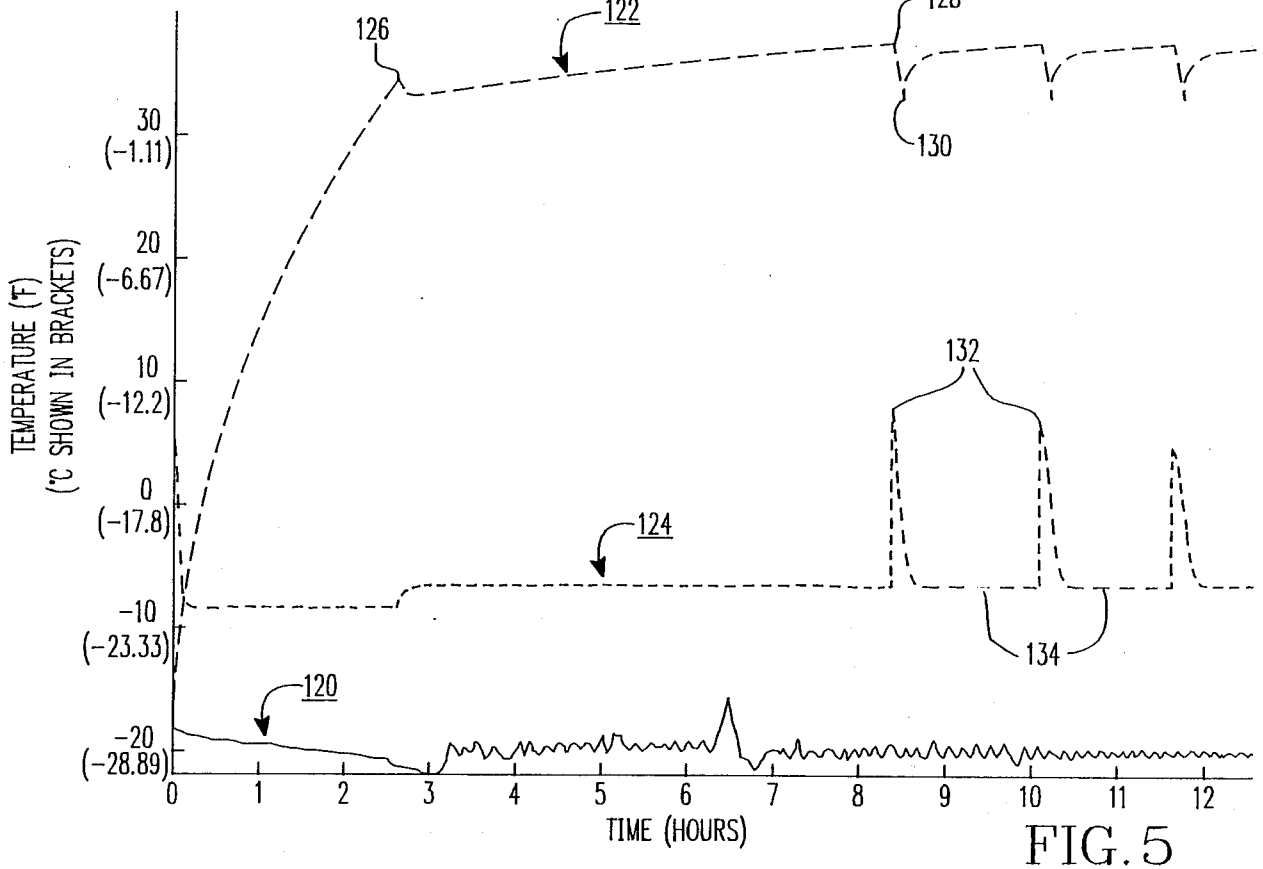
FIG. 5 is a graph similar to that of FIG. 2, except with the transport refrigeration system constructed according to the teachings of the invention operated in an ambient of −20° F. (−28.89° C.).

FIGS. 4 and 5 are graphs which illustrate the effectiveness of a transport refrigeration system using refrigerant R12 which was constructed according to the teachings of the invention and operated with ambients of 0° F. (−17.8° C.) and −20° F. (−28.89° C.), respectively. The transport refrigeration system was controlled by a thermostat 84 set to call for a temperature of 35° F. (1.67° C.) in a controlled space 92.

In FIG. 4, curve 106 represents an ambient temperature of 0° F. (−17.8° C.) versus time in hours, curve 108 plots the temperature of the served space 92 versus time, and curve 110 plots the difference between the temperature of the air entering the evaporator of the transport refrigeration system and the temperature of the air leaving the evaporator. A difference or "delta" above the zero level of the graph indicates the outlet air is colder than the inlet air, i.e., a cooling cycle, and a delta below the zero level indicates the outlet air is warmer than the inlet air, i.e., a heating cycle. The temperature of the served space was initially at 0° F. (−17.8° C.), with the system being in a high speed heating mode until reaching point 112, at which time the system shifted to a low speed heating mode. At point 114 the system switched to a low speed cooling mode, and then the system cycled between low speed heat and low speed cool, to hold the set point of 35° F. (1.67° C.). The difference or delta between the evaporator air inlet and outlet temperatures, represented by curve 110, indicates the effectiveness of the invention, as with prior art systems the heating capacity drops after each cooling cycle at ambients of +15° F. (−9.44° C.) and below, indicating that refrigerant was being trapped in the condenser. The peaks 116 represent cooling cycles and the valleys 118 represent heating cycles. The substantially constant depth of the valleys 118 indicate that the heating capacity is substantially constant during the cycling mode.

In FIG. 5, curve 120 represents the ambient temperature of substantially −20° F. (−28.89° C.) versus time in hours, curve 122 plots the temperature of the served space, and curve 124 indicates the evaporator delta. The temperature of the served space started at −15° F. (−26.12° C.) and the system operated in a high speed heating mode until reaching point 126, at which time the compressor prime mover 16 shifted to low speed. The system remained in low speed heat until reaching point 128, where it shifted to low speed cool. At point 130 the system returned to low speed heat, followed by cycling between low speed heat and low speed cool. The peaks 132 on the evaporator delta curve 124 indicate cooling cycles, and the valleys 134 represent heating cycles. Note that the valleys 134 return to substantially the same depth after each cooling cycle, again indicating that there is no significant loss of heating capacity following each cooling cycle.

We claim as our invention:

1. In a transport refrigeration system which holds a set point temperature via heating and cooling cycles, a refrigerant circuit which includes a compressor, condenser, receiver, evaporator, and accumulator, mode selector valve means having heating and cooling positions, and control means for providing a heat signal when the need for a heating cycle is detected, the improvement comprising:

means responsive to said heat signal for connecting the receiver and accumulator in direct fluid flow communication, and time delay means responsive to said heat signal which operates said mode selector valve means from the cooling position to the heating position after a predetermined time delay, whereby a condenser flushing mode occurs prior to each heating cycle, which forces liquid refrigerant trapped in the condenser to flow to the accumulator via the receiver, to enhance the heating capacity of the system.

2. The transport refrigeration system of claim 1 wherein the receiver has an inlet connected to the condenser and an outlet, and including a check valve located to prevent refrigerant flow into the outlet of the receiver.

3. The transport refrigeration system of claim 2 wherein the heat signal is maintained following the expiration of the time delay, and the means responsive to the heat signal for connecting the receiver in direct fluid flow communication with the accumulator maintains the connection between the receiver and accumulator during the heating cycle which follows the expiration of the time delay.

4. A method of improving the heating capacity of a transport refrigeration system which maintains a selected set point temperature in a served space by heating and cooling cycles, including a refrigerant circuit which includes a compressor, condenser, receiver, evaporator, and accumulator, and mode selector valve means operable to initiate a selected one of the heating and cooling cycles, the steps of:

providing a heat signal when the need for a heat cycle is detected during a cooling cycle, connecting the receiver and accumulator in direct fluid flow communication when the heat signal is provided, initiating a predetermined timing period in response to the heat signal, maintaining the mode selector valve means in a cooling cycle position during the timing period, and operating the mode selector valve means to select the heating cycle at the expiration of the timing period, whereby continuing the cooling cycle for the time delay period while the receiver is connected to the accumulator forces liquid refrigerant in the condenser to be transferred to the accumulator for availability during the heating cycle.

5. The method of claim 4 including the step of preventing refrigerant from flowing into the receiver, other than from the condenser.

6. The method of claim 5 including the step of maintaining the connection between the receiver and accumulator during the heating cycle, to transfer any liquid refrigerant which may flow back towards the receiver from the evaporator to the accumulator.

7. In a transport refrigeration system which holds a set point temperature via heating and cooling cycles, a refrigerant circuit which includes a compressor, condenser, receiver, evaporator, and accumulator, mode selector valve means having heating and cooling positions, and control means for providing a heat signal when the need for a heating cycle is detected, the improvement comprising:

first means responsive to said heat signal for connecting the receiver and accumulator in direct fluid flow communication, second means responsive to ambient temperature, and time delay means responsive to said first and second means, said time delay means operating said mode selector valve means from the cooling position to the heating position after a predetermined time delay in response to the heat signal being provided by said control means when the second means is indicating the ambient temperature is below a predetermined value, whereby a condenser flushing mode occurs prior to each heating cycle while the ambient temperature is below the predetermined value, which forces liquid refrigerant trapped in the condenser to flow to the accumulator via the receiver, to enhance the heating capacity of the system.

8. A method of improving the heating capacity of a transport refrigeration system which maintains a selected set point temperature in a served space by heating and cooling cycles, including a refrigerant circuit which includes a compressor, condenser, receiver, evaporator, and accumulator, and mode selector valve means operable to initiate a selected one of the heating and cooling cycles, the steps of:

providing a heat signal when the need for a heat cycle is detected during a cooling cycle, providing an ambient temperature signal when the ambient temperature is below a predetermined value, connecting the receiver and accumulator in direct fluid flow communication when the heat signal is provided while the ambient temperature signal is being provided, initiating a predetermined timing period when the heat signal is provided while the ambient temperature signal is being provided, maintaining the mode selector valve means in a cooling cycle position during the timing period, and operating the mode selector valve means to select the heating cycle at the expiration of the timing period, whereby continuing the cooling cycle for the time delay period while the receiver is connected to the accumulator forces liquid refrigerant in the condenser to be transferred to the accumulator for availability during the heating cycle.

* * * * *